US007451528B2

(12) United States Patent
Sima

(10) Patent No.: US 7,451,528 B2
(45) Date of Patent: Nov. 18, 2008

(54) DEVICE FOR THE CONNECTION OF AN END PART OF A BAND TO A STATIONARY PART

(75) Inventor: Wolfgang Sima, Keutschach (AT)

(73) Assignee: Hirsch Armbänder GmbH, Klagenfurt (AU)

( * ) Notice: Subject to any disclaimer, the term of this patent is extended or adjusted under 35 U.S.C. 154(b) by 0 days.

(21) Appl. No.: 11/083,200

(22) Filed: Mar. 18, 2005

(65) Prior Publication Data

US 2005/0235464 A1 Oct. 27, 2005

(30) Foreign Application Priority Data

Apr. 22, 2004 (AT) ..... GM304/2004 U

(51) Int. Cl.
*A44C 5/00* (2006.01)
*A44C 5/14* (2006.01)

(52) U.S. Cl. ..... 24/265 WS; 24/265 B

(58) Field of Classification Search ..... 24/265 WS, 24/33 B, 265 B, 906; 368/282; 16/386, 285, 16/286, 235, 236, 238, 239; 81/341, 394
See application file for complete search history.

(56) References Cited

U.S. PATENT DOCUMENTS 1,784,887 A * 12/1930 Campbell ..... 24/265 WS
2,510,938 A * 6/1950 Boots ..... 24/265 WS
2,876,521 A * 3/1959 Legman ..... 24/265 WS
2,948,941 A 8/1960 Bruhn et al.
3,123,882 A * 3/1964 Meyerson ..... 24/265 B
4,329,329 A * 5/1982 Dolkemeyer et al. ..... 423/449.2
4,419,770 A * 12/1983 Yagi et al. ..... 455/301
5,689,867 A * 11/1997 Katz ..... 24/265 WS
5,951,193 A 9/1999 Yamamoto et al.
6,212,414 B1 * 4/2001 Alameh et al. ..... 455/575.6
2003/0035347 A1 2/2003 Yokosuka

FOREIGN PATENT DOCUMENTS

| | | |
|---|---|---|
| DE | 2 245 202 | 3/1973 |
| DE | 2 249 827 | 4/1974 |
| EP | 1 106 096 | 6/2001 |

* cited by examiner

*Primary Examiner*—Robert J Sandy
(74) *Attorney, Agent, or Firm*—Dickstein Shapiro LLP

(57) ABSTRACT

In a device for the connection of an end part (5) of a band (1) to a rigid part (2), in particular a watchband to a watch casing, a pin (3) arranged at the end part (5) of the band (1) and extending, with its longitudinal axis, transversely to the longitudinal direction of the band (1) can be engaged with at least one recess (7) of the rigid part (2).

In order to attach the band (1) to the rigid part (2)—even if said part has different shapes—with as little clearance as possible, the device is characterized in that the pin (3) is movable into different positions relative to the band (1) in a direction transverse to its longitudinal axis and can be fixed to the band (1) in these positions which it can assume relative to the band (1).

31 Claims, 5 Drawing Sheets

1
2
3
3'
4
6
7
8
8
9
10
II
II

FIG. 6
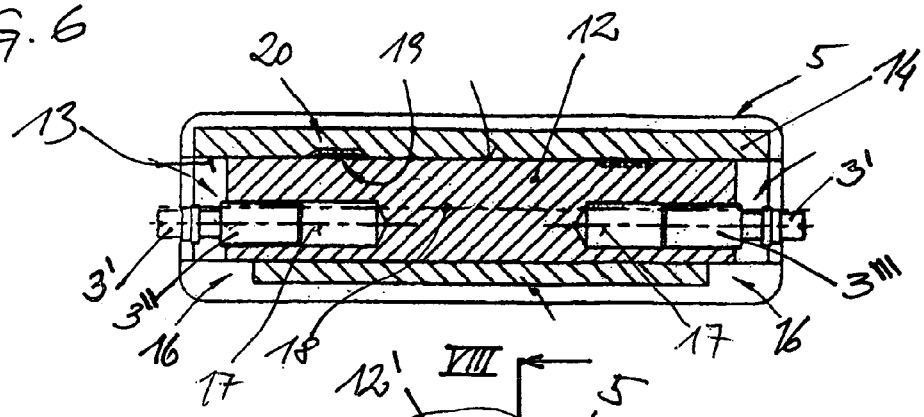
FIG. 7
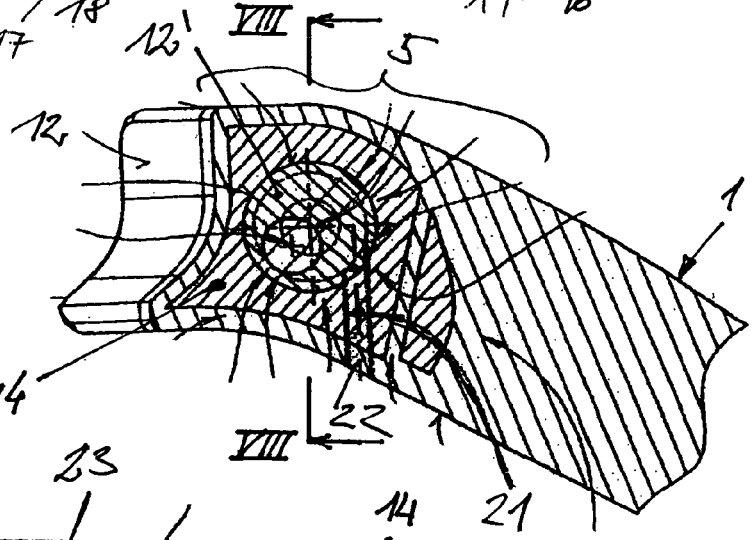
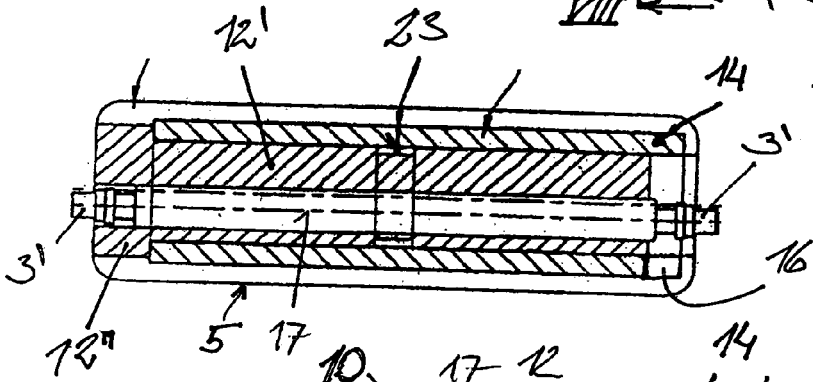
FIG. 8
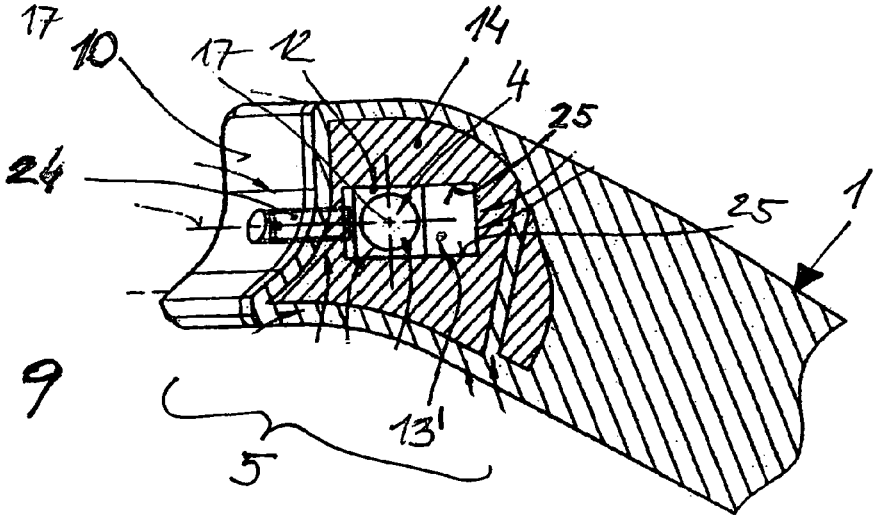
FIG. 9

DEVICE FOR THE CONNECTION OF AN END PART OF A BAND TO A STATIONARY PART

The invention relates to a device for the connection of an end part of a band to a rigid part, in particular a wristband such as a watchband to a casing such as a watch casing, wherein a pin arranged at the end part of the band and extending, with its longitudinal axis, transversely to the longitudinal direction of the band can be engaged with at least one recess of the rigid part, as well as to a process for the manufacture of a wristband.

For the attachment of a watchband to a watch casing, it is known to stick a pin, at the end part of the watchband, which end part is adjacent to the watch casing, through a recess of said end part, which pin engages recesses of lugs or horns, respectively, projecting from the watch casing. Such a pin is often configured as a tubular element in which a spring is housed which presses against two pegs disposed at the ends of the tubular element, wherein at least one of said pegs is arranged so as to be movable in the tubular element so that it becomes possible for the pin to spring into the recesses of the horns of the watch casing. As a rule, the end part of the watchband is pivotable about the axis of the pin relative to the watch casing, the more so as usually a clearance is provided between the end part of the band and the watch casing (cf. DE 2 245 202 A).

The attachment of a watchband to a watch casing, with a resiliently deformable pin penetrating an end part of the watchband, is known, for instance, from DE 2 249 827 A, wherein, also in this case, a clearance permitting a swivelling movement is provided between the end part of the watchband and the watch casing.

In order to bridge over said clearance and ensure a harmonic connection of the watchband to the watch casing, which connection is free from play as much as possible, it is known to arrange end pieces, preferably made of metal and adapted to the curvature of the watch casing, at the end part of the watchband, as can be learnt, for instance, from U.S. Pat. No. 2,948,941 A. In this way, a certain stability between the watchband and the watch casing is achieved as well so that, apart from the pleasing appearance, the watch can be prevented from falling into the ulna—which is caused by a loose articulation between the watchband and the watch casing.

This, however, involves the difficulty that, for different watch casings, different end parts have to be provided at the watchband, whereby specialized dealers and watchmakers, respectively, are required to keep a relatively complex storage system, in particular for the substitution or replacement of a watchband. Often it is necessary to keep at hand different watchbands for different watch casings.

The invention aims at avoiding these disadvantages and difficulties and has as its object to provide a device of the initially described kind by means of which a band can be attached to a rigid part—even if said part has different shapes—wherein in particular one and the same band can be connected to differently shaped rigid parts, with an adaptation that is optimal. The point is in particular that a watchband is attached to a watch casing, with the space between the pin and the wall of the casing being bridged.

With a device of the initially described kind, said object is achieved in accordance with the invention in that the pin is movable into different positions relative to the band in a direction transverse to its longitudinal axis and can be fixed to the band in these positions which it can assume relative to the band.

Thus, the invention forges a path which deviates from the prior art, that is to say, the final link of the band is not adapted to the rigid part to which it should be fastened but, according to the invention, it is possible to bridge over the distance between the pin and various rigid parts by means of one and the same end part by bringing the pin into different positions relative to the end part of the band; i.e., if the distance is larger, the pin in the end part of the band is shifted further to the back, if it is smaller, said pin is shifted to the front and may just as well be varied in terms of its height. Therefore, according to the invention, the pin is preferably movable in the longitudinal direction of the band or is suitably also movable in the thickness direction of the band, respectively.

A simple, inexpensive design of the device which permits a plurality of different positions of the pin relative to the end part of the band is characterized in that the pin can be inserted in a pin bearing which extends, with its longitudinal extension, in parallel to the pin, which bearing can, in turn, be shifted on the band in a transverse direction to the longitudinal axis of the pin and can be fixed in the positions which it can assume, with the pin bearing preferably exhibiting one or several recesses in which the pin can be inserted. It is also feasible to replace the pin bearing with another one which has a different position for a pin.

Another particularly favourable design which permits a plurality of different positions of the pin relative to the end part of the band is characterized in that the pin can be inserted in a pin bearing which extends, with its longitudinal axis, in parallel to the pin, which bearing can, in turn, be inserted in a recess of the end part of the band in different rotary positions relative to the longitudinal axis of the pin bearing, and that the pin bearing exhibits at least one recess eccentrically to its longitudinal axis for receiving the pin.

In this respect, the pin bearing suitably exhibits, across its longitudinal extension, a cross-section in the shape of a regular polygon and the end part of the band exhibits a corresponding recess for receiving the pin bearing.

In this manner, it is possible to insert the pin bearing in different rotary positions in the end part of the band, whereby it becomes feasible to achieve, in every rotary position, a new position of the pin relative to the end part of the band, which position is shifted either in the thickness or in the longitudinal direction of the band.

Further preferred embodiments are characterized in that the pin bearing exhibits, across its longitudinal extension, a cross-section in the shape of a circle, a rectangle or a star and the end part of the band exhibits a corresponding recess for receiving the pin bearing. If the pin bearing is provided, for example, with a cross-section in the shape of a circle, the pin arranged in the pin bearing can be adjusted very precisely by turning said pin bearing against the end part of the band.

Preferably, the band is provided, at its end part receiving the pin, with a reinforcing piece which either receives the pin directly or receives the pin via the pin bearing.

If the pin is arranged asymmetrically in the pin bearing, different positions of the pin relative to the end of the band can also be achieved by inserting the pin bearing in the band or in a reinforcing piece provided at the band, respectively, with the pin bearing being turned about the longitudinal direction of the band.

In order to secure the pin bearing versus the band or versus the reinforcing piece, respectively, the pin bearing can preferably be fixed to the band or to the reinforcing piece of the band, respectively, by means of a safety device such as a lug, an attachment screw, a change in cross-section etc. to prevent lateral displacement.

For some variants it can be advantageous if at least one set screw is provided for adjusting the pin or the pin bearing, respectively, by means of which set screw the pin or the pin bearing, respectively, can be displaced relative to the band in an oblong hole provided at the pin bearing, at the end part of the band or at a reinforcing piece of the band, respectively. This applies, for example, to a pin bearing having a circular cross-section.

In order to ensure a perfect position of the pin bearing relative to the end part of the band and a gap-free fit of the end part of the band against the rigid part, the pin bearing is suitably inserted at the end part of the band or at the reinforcing piece, respectively, by means of a press fit.

In order to secure the reinforcing piece versus the band, said piece is fixed relative to the band with positive fit according to a preferred embodiment, preferably the end part of the band or an optionally provided reinforcing piece, respectively, is adapted to the shape of the rigid part, wherein only a rough adjustment is necessary, with tolerances being disregarded, if the end part of the band or an optionally provided reinforcing piece, respectively, is formed from a resiliently deformable material such as rubber, a synthetic material, in particular a thermoplastic material or thermoplastic elastomers.

Preferably, the pin bearing is formed from a material of higher hardness and strength than the end part of the band or an optionally provided reinforcing piece.

In order to determine the correct position of the pin in a simple manner, the band as an adapting band exhibits, on its end part, an opening extending from its top side to the pin bearing, and the pin bearing is provided with markings which come to rest in the opening and identify the positions thereof, wherein the width of the adapting band is advantageously dimensioned smaller than the distance between the horns of a watch casing.

A band shaped in accordance with the invention is preferably manufactured in that at least the formation of the end part of the band and the production of a reinforcing piece provided at the end part of the band, respectively, are carried out by injection moulding.

In the following, the invention is illustrated in greater detail by way of several exemplary embodiments illustrated in the drawing, wherein FIG. 1 shows a diagonal view of a band attached to a watch casing and FIG. 2 shows a section taken on the lines II-II of FIG. 1.

FIG. 6 shows a section through an end part of the band and through the pin in a transverse direction to the longitudinal extension of the band.

FIGS. 7 and 9 illustrate further variants in an illustration analogous to FIG. 2 and FIG. 8 shows a section along the line VIII-VIII of FIG. 7.

Figure 1:
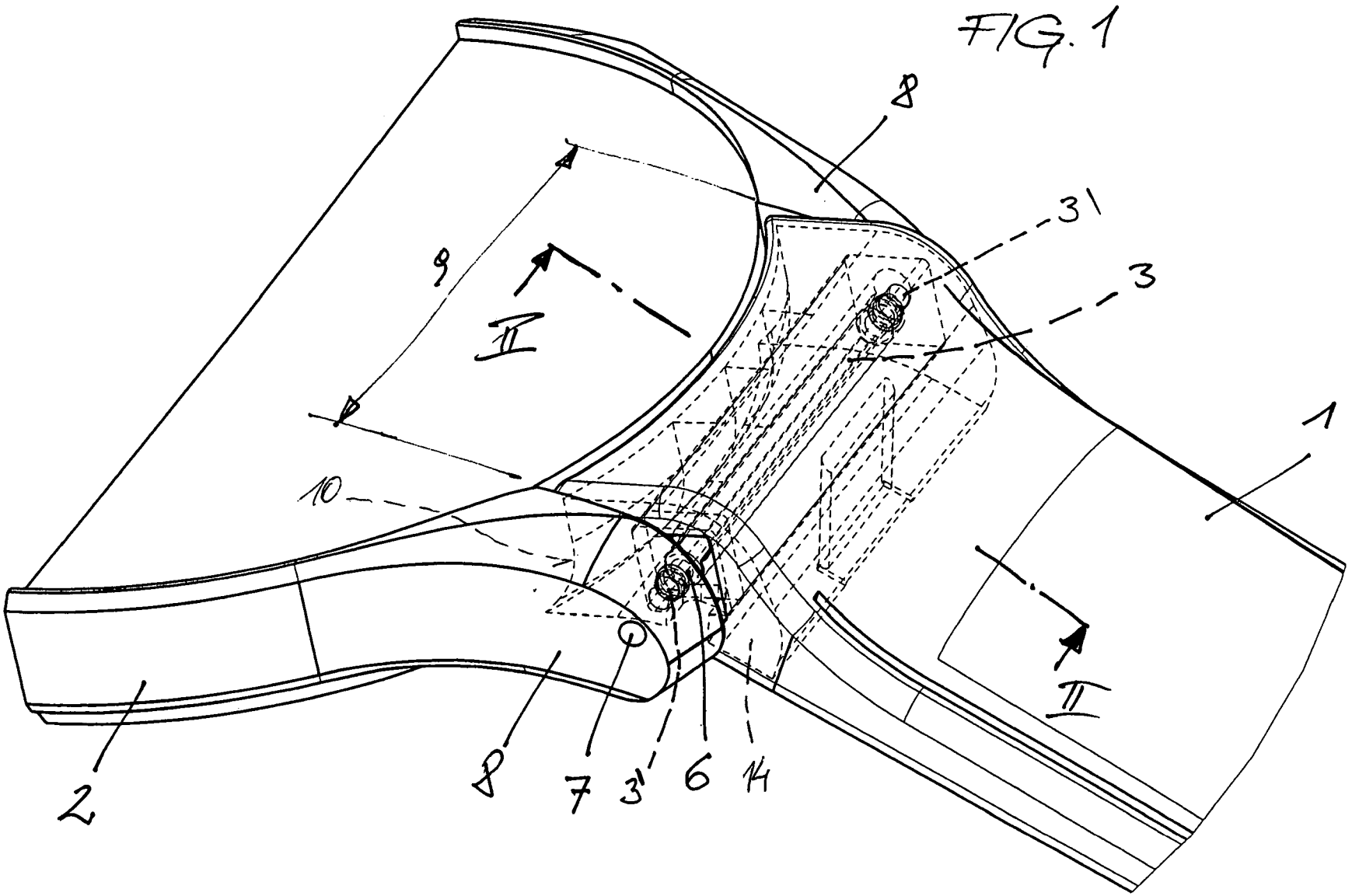

In order to fasten a watchband 1 to a watch casing 2, a pin 3, preferably a spring pin, penetrates a recess 4 of an end part 5 of the watchband 1 and, with its peg-shaped ends 6, locks into place in recesses 7 of lugs or horns 8, respectively, projecting from the watch casing 2, between which the end part 5 of the watchband 1 comes to rest. The width 9 of the watchband 1 is dimensioned according to the distance between the two horns 8 of the watch casing 2. In the non-installed state, the end side 10 of the end part 5 of the watchband 1, which end side is facing the watch casing 2, roughly corresponds to the curvature displayed by the watch casing 2 between the two horns 8, namely both in the peripheral direction and in a direction which is vertical thereto.

Figure 2:
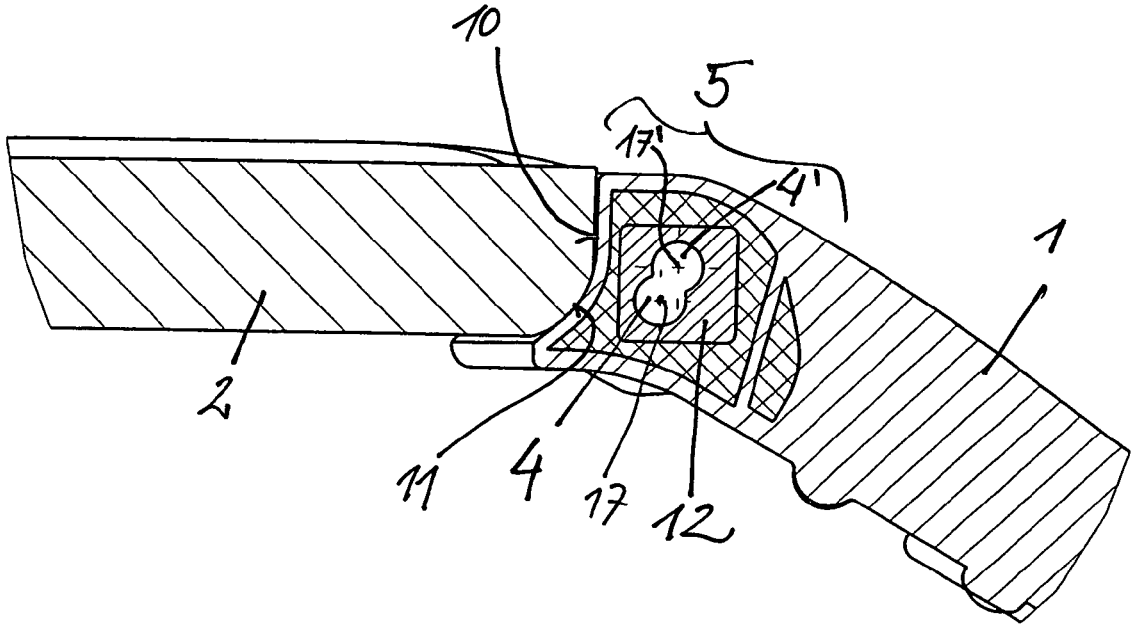

As can be seen in particular in FIGS. 1 and 2, the end side of the end part 10 of the watchband 1 rests against the surface 11 of the watch casing 2 between the horns 8 in a manner free from play almost across its entire extension, whereby the watchband 1 is no longer movable about the pin 3 in a freely articulated fashion, but a certain stability is achieved between the watch casing 2 and the watchband 1 and the watch casing 2 is prevented from falling into the ulna.

Figure 3:
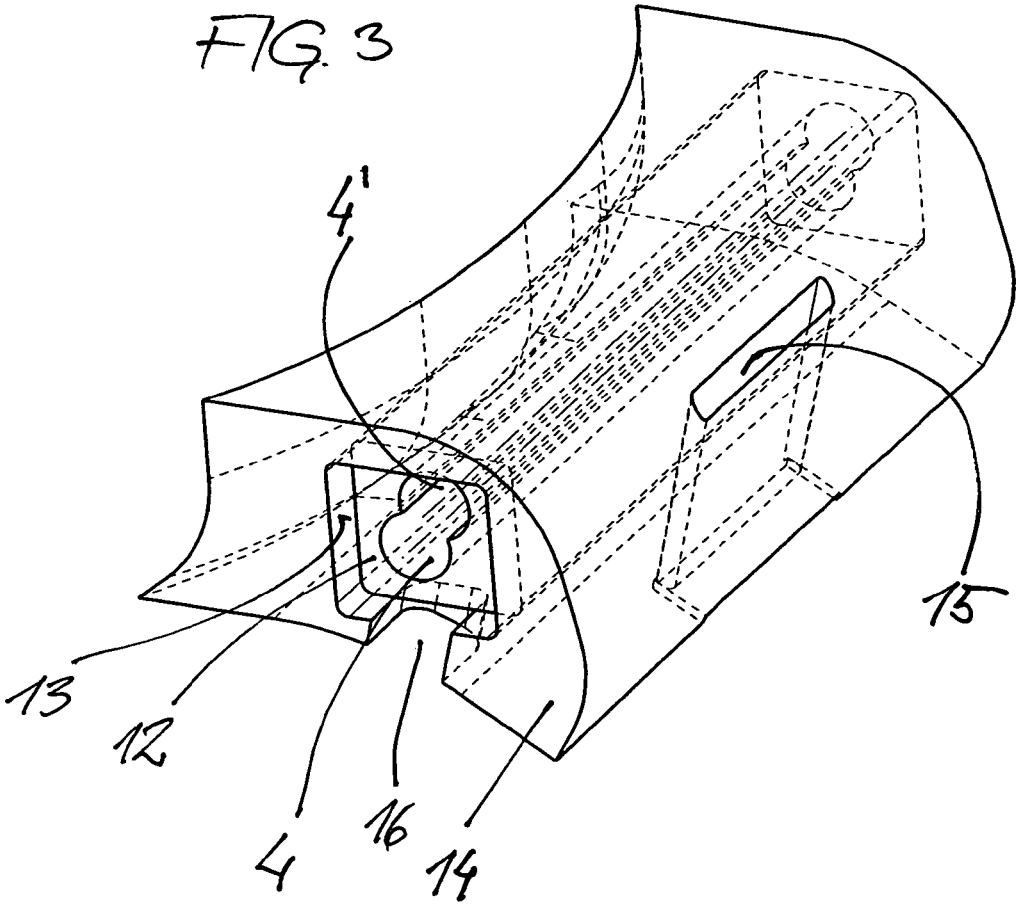
FIG. 3 illustrates a detail of FIG. 1 also in diagonal view, on an enlarged scale.

In the exemplary embodiment illustrated in FIGS. 1 to 3, the watchband 1 is configured as a plastic watchband, whereby resilience is provided as a result of the elastic behaviour of the synthetic material. It is essential for the invention that a contact, namely a contact that is as gap-free as possible, is obtained between the end part 5 of the watchband 1 and the watch casing 2, which is achieved as follows:

According to the embodiment illustrated in FIGS. 1 to 3, the pin 3 is inserted in a recess 4 of a pin bearing 12 with as little play as possible or in a manner free from play, respectively, as will be illustrated thereinafter. The pin bearing 12 itself exhibits a square cross-section and is inserted in a recess 13 of a reinforcing piece 14 cast in the end part 5 of the watchband 1, which recess corresponds to the cross-section of the pin bearing. For a better fastening of the reinforcing piece 14 to the end part 5 of the watchband 1, the reinforcing piece 14 exhibits a recess 15 running through it in a transverse direction to its longitudinal extension, which recess is filled with the material of the watchband when manufacturing the watchband, thus providing the reinforcing piece 14 with an additional security against being laterally displaced and ripped out of the watchband 1.

In the longitudinal direction of the watchband 1, the reinforcing piece 14 itself is entirely surrounded by the material of the watchband 1. On its bottom side, it is provided with a recess 16 protruding from the outside to the pin bearing 12 so that it becomes possible to loosen the pin 3, for example a spring pin, i.e. to withdraw an end part 3' of the spring pin (cf. FIGS. 6 and 8) for the purpose of dismantling the watchband 1. For that reason, also the pin bearing 12 is dimensioned slightly shorter than the distance between the horns 8 of the watch casing 2.

The watchband 1 illustrated in FIG. 2 is made, as mentioned, from a synthetic material and is produced, for example, in an injection moulding process. In this case, the reinforcing piece can just as well be omitted. The pin bearing 12 is then inserted directly in the end part 5 of the watchband 1. If need be, the pin 3 can also be inserted directly in a recess 4 of the end part 5 of the synthetic band.

If the watchband 1 is configured as a leather wristband, it is usually provided with a shaft leather on its top side and with a lining leather on its side which lies against the wrist. Often a ply is provided between the two leather strips of the lining leather and the shaft leather, which strips are connected with each other at their rims (f.i. with a seam). In this case, the reinforcing piece 14 is particularly advantageous and is at least partially entwined by the lining leather and the shaft leather, with the lining leather being connected, for instance glued together, with the shaft leather roughly at half-height of the side of the reinforcing piece 14 facing the watch casing 2. However, it is also possible that the shaft leather entwines the reinforcing piece 14 up to the bottom side of the watchband 1 and is connected with the lining leather at the bottom side. The recess 15 which runs through the reinforcing piece 14 in a transverse direction to its longitudinal extension, is used, in case of a leather wristband, for threading through a fleece and connecting the same with the shaft leather and the lining leather or with the ply between the two leather strips so that the reinforcing piece 14 at the end of the watchband 1 will exhibit a good grip and is actually able to withstand tensile forces acting in the longitudinal direction of the watchband.

The reinforcing piece 14 exhibits a certain formability, which may, for example, be due to a resilience of said part 14, for the purpose of adaptability to the predetermined shape of the watch casing 1 between the horns 8. If said reinforcing piece 14 is not provided, for example if the entire watchband 1 is made from a single piece, the band end 5 itself exhibits this adaptability.

In this connection, it is appropriate that a contact between the watch casing 2 and the end part 5 of the watchband is maintained even after wearing the watch for a prolonged amount of time, which involves a permanent resistance of the end part 5 of the watchband 1 and hence also of the reinforcing piece 14. Therefore, as materials for the reinforcing piece 14 and for a plastic band, respectively, materials are suitably used which exhibit a hardness according to Shore A in a range of between 30 and 70. Furthermore, said materials should exhibit a permanent set at 100° C. after 24 hours in a range of between 40% and 70%. As materials, rubber, a synthetic material, in particular a thermoplastic material and thermoplastic elastomers, come into consideration. In this way, curvature differences between the watch casing 2 and the end part 5 of the watchband 1 can be compensated for to a certain degree.

The recess 4 for the pin 3 is arranged in the pin bearing 12 eccentrically and preferably also asymmetrically. According to the embodiment illustrated in FIGS. 1 to 3, two recesses 4, 4' for the pin 3 are provided, which, however, merge with each other. One of the recesses 4 lies with its longitudinal axis 17 against a diagonal of the cross-section of the pin bearing 12, the other recess 4' is located with its longitudinal axis 17' completely asymmetrically and at a different radial distance from the longitudinal axis 18 of the pin bearing 12 than the other recess 4.

In this way, it is possible to determine different positions of the longitudinal axis of the pin 3 relative to the watch casing 2, both in the direction of the thickness of the watchband 1 or the height of the watch casing 2, respectively, and in the direction of the longitudinal extension of the watch band 1, by means of different fitting positions of the pin bearing 12 relative to the reinforcing piece 14, i.e. by extracting the pin bearing 12, rotating it by 90°, 180° or 270° about its longitudinal axis 18 and reinserting it in the reinforcing piece 14. If a close contact and a slight pressing of the end surface 10 of the end part 5 of the watchband 1 against the watch casing 2 should be achieved, it is merely necessary to bring the pin bearing 12 into the proper position, i.e. into the proper rotary position about its longitudinal axis 18 so that the pin 3 will press the end part 5 of the watchband 1 against the watch casing 2 or will bring it into an at least partial contact with the same, as the pin locks into place in the recesses 7 of the horns 8 of the watch casing 2.

An asymmetrical position of the recess 4' for the pin 3 in the pin bearing 12 renders possible a further differentiation by inserting the pin bearing 12, which is turned about the longitudinal axis of the watchband 1, in the recess 13 of the reinforcing piece 14.

Figure 4:
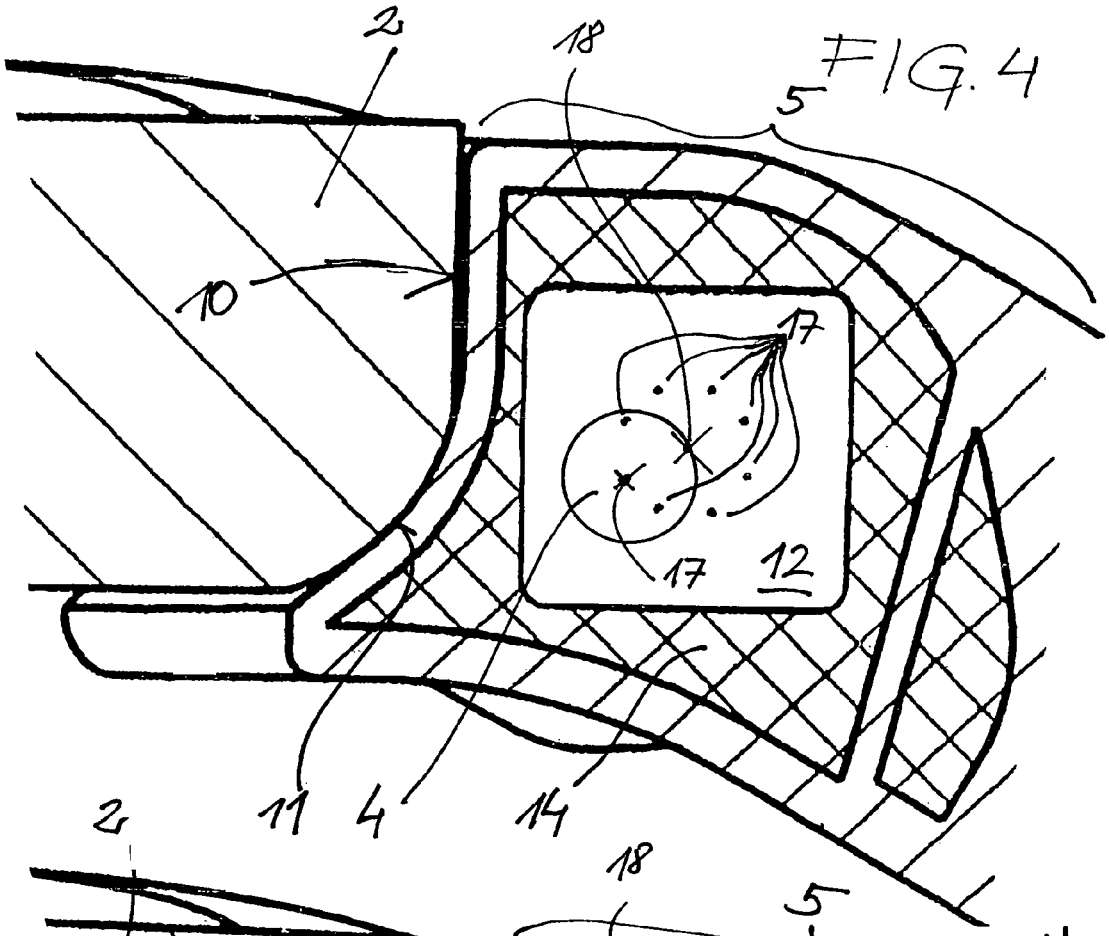
FIGS. 4 and 5 show variants in an illustration which is analogous to FIG. 2 but is enlarged as well.
Figure 5:
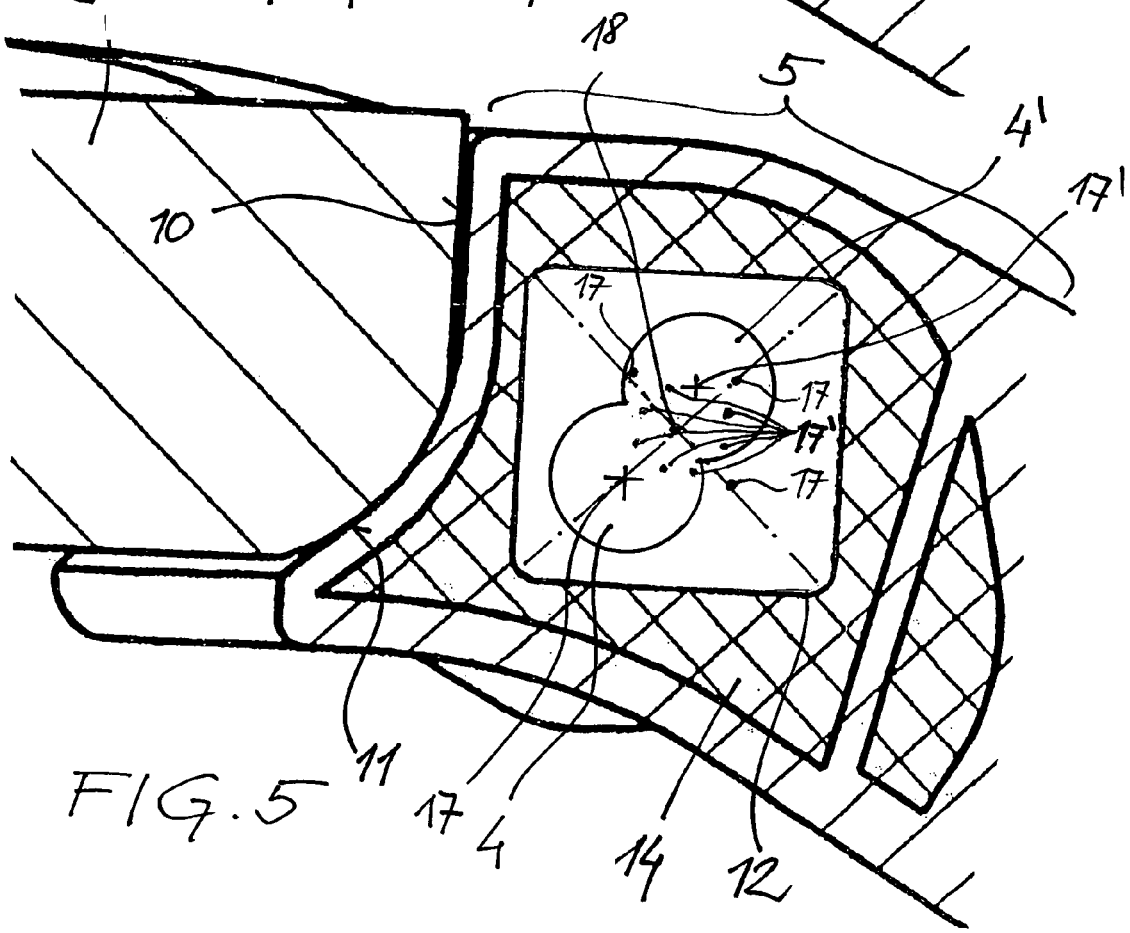

FIG. 4 illustrates the different positions of the longitudinal axis 17 of the recess 4 for the pin 3 which can be achieved if a single recess 4 is provided in the pin bearing 12 in an asymmetrical manner. In FIG. 5, this is illustrated for two recesses 4, 4' provided in the pin bearing 12.

According to FIG. 6, the pin 3 has a two-piece design and each of the two parts 3" and 3'" is inserted in a separate recess 4', 4" of the pin bearing 12, which recesses 4', 4" are arranged in alignment with each other.

The pin bearing 12 is preferably inserted in the recess of the reinforcing piece 14 by means of a press fit; for securing the position along the longitudinal axis 18 thereof, additional latches 19 may, for example, be provided which cause a certain snapping of the pin bearing 12 in the reinforcing piece 14, if those latches 19 lock into place in corresponding recesses 20 after the positioning of the pin bearing 12.

Of course it is possible to select a different cross-sectional shape than a square one for the pin bearing 12, it would, for example, be possible to select the shape of an equilateral triangle or also the shape of a rectangle or a circular cross-section, the latter being illustrated, for example, in FIGS. 7 and 8. If the pin bearing 12 has a circular cross-section, the recess 4 is provided eccentrically, and a safety screw 21 is suitably provided for securing the position (rotary protection) of the pin bearing 12 relative to the reinforcing piece 14, which safety screw can, for example, be screwed into a threaded hole 22 of the reinforcing piece 14 and engages a peripheral groove 23 provided roughly at the centre of the longitudinal extension of the pin bearing 12, whereby, at the same time, the position of the pin bearing 12 in the direction of its longitudinal axis 18 is determined as well. A lateral shoulder 12" or a groove at an end surface of the pin bearing 12 serves for twisting the pin bearing 12.

In FIG. 9, a further variant is illustrated according to which the pin bearing 12 is displaceably guided on the level of the watch casing 2, in a recess 13' of the reinforcing piece 14, which recess extends roughly in the longitudinal direction of the end part 5 of the watchband 1 or on a level of the watch casing 2, respectively. The position of the pin bearing 12 within said recess 13' can thus be determined at varying distances from the watch casing 2, wherein an adjusting means such as, for instance, two set screws 24 spaced apart from each other, is provided for the determination, which means is preferably operable from the end surface 10 of the end part 5 of the watchband 1, which surface is facing the watch casing 2, i.e. it can be operated prior to positioning the watchband 1 at the watch casing 2. In the recess 13', two opposing guide surfaces 25 are provided, along which the pin bearing 12 is guided which, in this case, may be contacted with those guide surfaces 25, with the outer surfaces being parallel to each other.

In this case, the fixing of the pin bearing 12—and hence of the pin 3—in the direction toward the watch casing 2 is sufficient, since, with the watchband 1 being installed, a movement of the watchband 1 toward the watch casing 2 is impossible if there is a contact between the watch casing 1 and the end part 5. As a matter of course, the recess 4 can be located off-centre of the pin bearing 12, whereby it is possible to insert the pin bearing 12 also in a turned position, hence facilitating further positions of the pin 3 relative to the watch casing 1.

The invention can be realized with different watchbands 1, for example, also with multilayered and with leather wristbands; just as with steel wristbands which are formed, for example, by link bodies hinged to each other.

If only a small number of adjustment variants of the watchband 1 relative to a watch casing 2 is required, it may possibly suffice to get by without a pin bearing 12 and to provide several recesses in the end part 5 of the watchband 1 or the reinforcing piece 14 thereof, respectively, at different height and distance levels from the end surface 10 of the end part 5.

Figure 10:
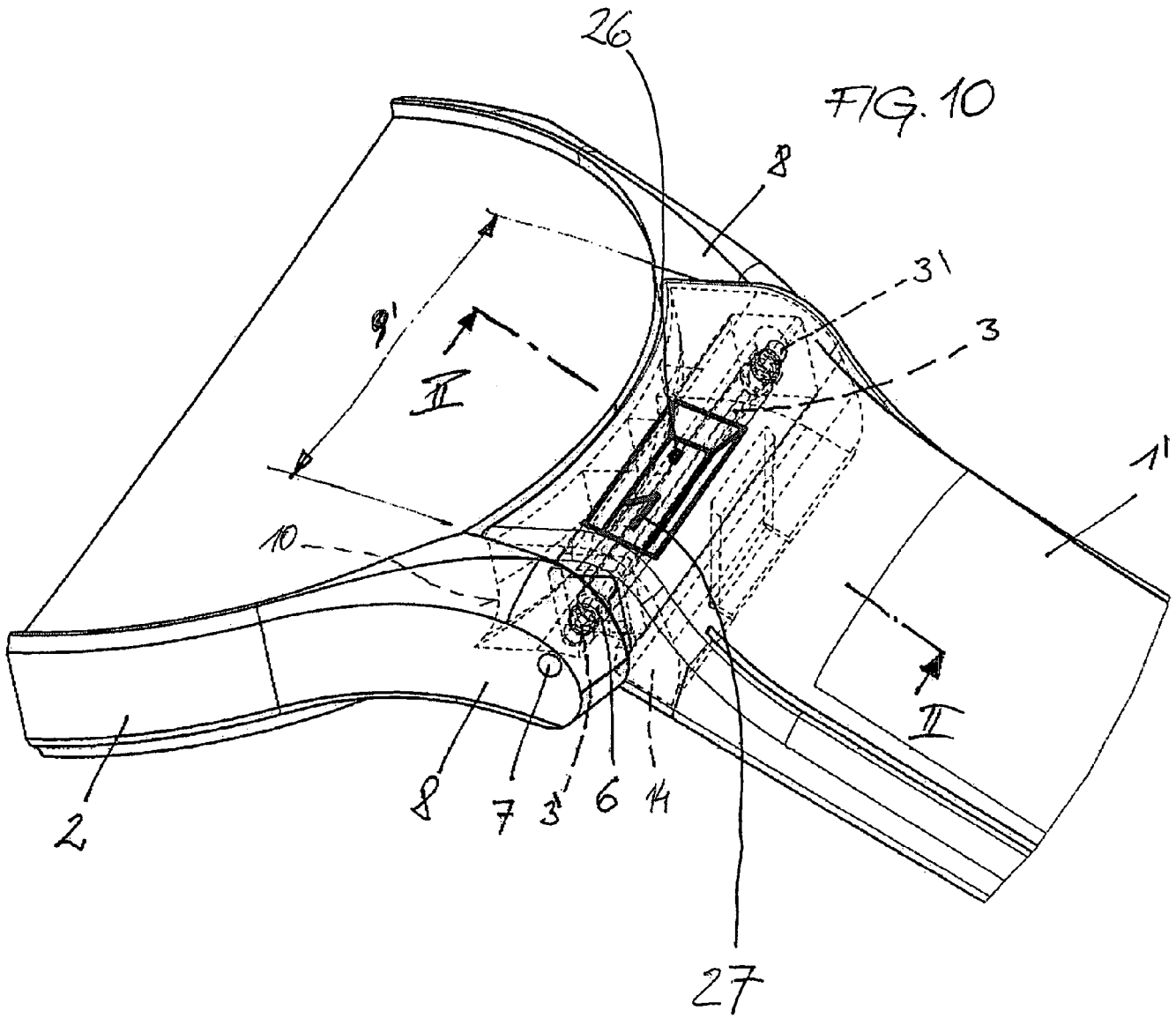
FIG. 10 illustrates an adapting band functioning as an auxiliary setting device in an illustration analogous to FIG. 1.

In FIG. 10, a so-called adapting band 1' is illustrated, which serves as an auxiliary setting device for finding the correct position of the pin 3 in a watchband 1. Said adapting band 1', which, in terms of its interior, i.e. regarding the pin bearing 12, is designed identically to the watchband 3 illustrated in FIG. 1, exhibits, on its top side, an opening 26 at the end part 5, which opening extends to the recess 13 for the pin bearing 12 so that, from above, a partial view of the pin bearing 12 becomes possible.

The pin bearing 12 itself exhibits markings 27 at the periphery, for example numerals from "1" to "8", with one numeral being attached to a peripheral side in each case in such a manner that one numeral is visible through the recess 26 if the pin bearing 12 is inserted. Thereby, the numerals 1 to 4 stand for the pin bearing 12 in a first position, and the numerals 5 to 8 stand for the pin bearing in the turned position (turned about the longitudinal direction of the adapting band 1'). For that reason, the opening 26 is not arranged at the centre of the width of the adapting band 1' but is shifted closer to an edge region of the band.

The adapting band 1' suitably has a width 9' which is dimensioned slightly smaller than the distance between the horns 8 of the watch casing 2 so that the correct latching of the pin 3, i.e. the end parts 3' thereof, in the recesses 7 can be checked.

By means of the adapting band 1', the ideal position of the pin bearing 12 can thus be determined by detecting the numeral appearing in the recess, and the pin bearing 12 can then be incorporated in the actual watchband 1 in this very position.

The invention can also be used for bands other than watchbands which have to be mounted to a rigid part, for example for a cell phone, a play-back device for a music storage system etc.

The invention claimed is:

1. An adjustable wristband, comprising:

an end part comprising a channel extending transversely to a longitudinal direction of the band;

an oblong-shaped pin bearing comprising a body portion connecting first and second end sections, the body portion extending entirely between the first and second end sections and entirely within the channel;

first and second pin sections having a longitudinal axis extending from an eccentric pin position of the first and second end sections, such that the longitudinal axis is transverse to the longitudinal direction of the band, the eccentric pin positions being offset from a concentric center of the first and second end sections, characterized in that the pin sections are adjustably secured into different positions relative to the band, in a direction transverse to the longitudinal axis, by selectively repositioning the first and second pin sections such that their longitudinal axis extends from a new eccentric pin position of the first and second end sections or by rotating the body portion of the pin bearing to selectively reposition the first eccentric pin position with respect to the channel.

2. A device according to claim 1, characterized in that the pin sections are movable in the longitudinal direction of the band.

3. A device according to claim 1, characterized in that the pin sections are movable in the thickness direction of the band.

4. A wristband according to claim 1, characterized in that the pin sections are adjustably secured into different positions by rotating the pin bearing with respect to the channel, and in that the pin bearing and the pin sections form a single integral piece.

5. A device according to claim 1, further comprising:

a pin including the pin sections, characterized in that the pin bearing exhibits one or several recesses in which the pin can be inserted at the eccentric pin positions.

6. A device according to claim 5, further comprising:

a pin including the pin sections, characterized in that the pin bearing extends with its longitudinal axis in parallel to the pin and is configured to be inserted into the channel at different rotary positions relative to its longitudinal axis.

7. A device according to claim 1, characterized in that the pin bearing and channel each exhibits, across its longitudinal extension, a cross-section in the shape of a regular polygon, such the pin bearing can only be rotated with respect to the channel by removing and then reinserting the pin bearing.

8. A device according to claim 1, characterized in that the pin bearing and channel each exhibits, across its longitudinal extension, a cross-section in the shape of a circle, such the pin bearing can be rotated with respect to the channel without removing the pin bearing from the channel.

9. A device according to claim 8, characterized in that the rotary position of the pin bearing is fixed by a safety screw extending through to the channel.

10. A device according to claim 8, characterized in that the pin bearing is secured within the channel by means of a press fit.

11. A wristband according to claim 1, characterized in that the end part comprises a reinforcing piece including the channel.

12. A wristband according to claim 11, characterized in that the reinforcing piece is affixed to the band with a positive fit.

13. A wristband according to claim 1, characterized in that the pin bearing is a single integral piece.

14. A device according to claim 1, characterized in that the rigid casing contains a cell phone or music playback device.

15. A device according to claim 1, wherein the rigid casing is a watch casing.

16. A wristband according to claim 1, characterized in that the end part of the band is formed from a resiliently deformable material.

17. A wristband according to claim 1, characterized in that the pin bearing is formed from a material of higher hardness and strength than the end part of the band.

18. A wristband according to claim 1, characterized in that the pin sections are adjustably secured by rotating the pin bearing with respect to the channel, the end part of the band exhibits an opening extending to the pin bearing, and the pin bearing is provided with markings which come to rest in the opening and identify the different positions of the pin sections.

19. A device according to claim 1, characterized in that the pin sections are adjustably secured by rotating the pin bearing with respect to the channel.

20. A wristband according to claim 1, characterized in that at least the end part of the band is formed by injection moulding.

21. A wristband according to claim 1, further comprising:

a pin including the first and second pin sections, characterized in that the pin bearing has at least two recesses for selectively receiving the pin at one of the first and second eccentric pin positions, respectively.

22. A wristband according to claim 21, characterized in that the pin sections are selectively repositioned by shifting the pin between the at least two recesses.

23. A wristband according to claim 21, characterized in that the pin sections are selectively repositioned by selectively inserting the pin into one of the at least two recesses.

24. A method of adjusting the end part of a wrist band relative to a rigid casing, comprising:

securing an oblong-shaped pin bearing within a channel of the end part of the band, the pin bearing and channel extending transversely to a longitudinal direction of the band, the pin bearing having first and second end sections;

arranging first and second pin sections at eccentric pin positions of the first and second end sections, respectively, each of the pin sections extending transversely to the longitudinal direction of the band, each of the eccentric pin positions being offset from a concentric center of the respective first or second end section, adjustably changing the positions of the pin sections, relative to the band, by shifting the pin sections to new eccentric pin positions of the end sections or by rotating the pin bearing with respect to the channel.

25. A method according to claim 24, wherein the rigid casing is a watch casing.

26. A method according to claim 24, wherein the positions of the pin sections, relative to the band, are changed by shifting the pin sections to new eccentric pin positions of the end sections.

27. A method according to claim 26, wherein the pin sections form a single integral pin.

28. A method according to claim 24, wherein the positions of the pin sections, relative to the band, are changed by rotating the pin bearing with respect to the channel.

29. A method according to claim 28, wherein the pin bearing and pin sections form a single integral piece.

30. A method according to claim 24, wherein the pin bearing comprises a body portion extending entirely between the first and second end sections and contacting the channel to secure the pin bearing therein.

31. A wristband, comprising:

an end part of the wristband having a channel;

a pin bearing secured having a longitudinal axis transverse to a lengthwise direction of the band and secured within the channel of the end part, wherein the pin bearing is configured to slide within the channel along a sliding direction transverse to the longitudinal axis of the pin bearing; and a set screw extending, in the sliding direction, through the end part and into the channel to control the position of the pin bearing with respect to the end part.

* * * * *